United States Patent [19]

McInnes

[11] Patent Number: 4,621,497

[45] Date of Patent: Nov. 11, 1986

[54] HEAT ENGINE

[75] Inventor: Malcolm B. McInnes, Burwood East, Australia

[73] Assignee: Pyrox Limited, Victoria, Australia

[21] Appl. No.: 734,745

[22] Filed: May 15, 1985

Related U.S. Application Data

[63] Continuation of Ser. No. 435,735, Oct. 21, 1982, abandoned.

[30] Foreign Application Priority Data

Oct. 22, 1981 [AU] Australia ..... PF1261

[51] Int. Cl.[4] ..... F02G 1/04

[52] U.S. Cl. ..... 60/519; 60/517

[58] Field of Search ..... 60/517, 519, 650, 669, 60/682

[56] References Cited

U.S. PATENT DOCUMENTS

| | | | |
|---|---|---|---|
| 3,483,694 | 12/1969 | Huber et al. | 60/519 |
| 3,677,027 | 7/1972 | Granryd | 60/519 X |
| 4,138,847 | 2/1979 | Hill | 60/519 X |
| 4,179,890 | 12/1979 | Hanson | 60/519 |

FOREIGN PATENT DOCUMENTS

| | | |
|---|---|---|
| 914549 | 1/1963 | United Kingdom . |
| 1066881 | 4/1967 | United Kingdom . |
| 1197958 | 7/1970 | United Kingdom . |
| 1224163 | 3/1971 | United Kingdom . |
| 1402593 | 8/1975 | United Kingdom . |
| 1429341 | 3/1976 | United Kingdom . |

*Primary Examiner*—Stephen F. Husar

*Attorney, Agent, or Firm*—Cushman, Darby & Cushman

[57] ABSTRACT

A heat engine including a closed case having a cylindrical chamber with circumferential heat transfer surfaces in the form of radially projecting ribs. A displacer having complementary ribs around the outer surface is rotatably mounted within the chamber. Some of the displacer ribs are removed leaving a working space containing working fluid. A cylinder in the displacer opens into the working space and a piston reciprocates within the cylinder as the displacer rotates so as to alter the volume of the working space. Different parts of the circumference of the case are maintained at different temperatures during operation so that the working fluid is subjected to changes of temperature and pressure during operation. Apart from the basic sinusoidal movement of the piston a superimposing lower amplitude oscillation may be applied to provide control of the thermodynamic operating cycle.

21 Claims, 11 Drawing Figures

THE CARNOT CYCLE

THE STIRLING CYCLE

THE ERICSSON CYCLE

HEAT ENGINE

This is a continuation of application Ser. No. 435,735, filed Oct. 21, 1982, which was abandoned upon the filing hereof.

The present invention relates to heat engines, and in particular to engines that operate with efficient thermodynamic cycles.

As background to the invention, a short description of the so-called ideal thermodynamic cycles follows.

As is well known in the art, the Otto, Diesel and mixed cycles all have thermodynamic efficiencies less than the Carnot efficiency based upon the maximum and minimum temperatures in the cycle.

The Carnot cycle is not particularly attractive as a basis for a reciprocating engine using a perfect gas as a working fluid, because the mean effective pressure of the cycle is very small. This is apparent from the thin appearance of the cycle on the Pressure-Volume Diagram in FIG. 1*a*.

There are other cycles having the Carnot efficiency, which do not suffer from this defect. The cycle consisting of two constant volume processes and two isothermals is the Stirling cycle—see FIG. 1*b*. The heat supplied during process 2-3 is equal in quantity to the heat rejected during process 4-1. The temperature of the fluid varies between the same limits during these two processes. It is therefore theoretically possible for the heat rejected, $Q_{41}$, to be returned to the working fluid as $Q_{23}$. Ideally, this heat transfer can be accomplished reversibly in a regenerator.

With a perfect regenerator, the only heat added from an external source during the cycle is that which is transferred during the isothermal process 3-4, (i.e., at Ta), and the only heat rejected to an external sink is the quantity transferred during the isothermal process 1-2 (i.e., at Tb). It follows that the efficiency of the cycle is (Ta−Tb)/Ta. The mean effective pressure of this cycle is much greater than that of the Carnot cycle and is comparable to that of the Otto cycle.

A similar cycle, the Ericsson cycle, consists of two constant pressure processes and two isothermals—see FIG. 1*c*. In this case, the heat rejected during one constant pressure process is returned via a regenerator to the working fluid during the other constant pressure process and again the cycle has the Carnot efficiency.

The heat engine of the present invention has been primarily designed for operation with reversible thermodynamic cycles such as, or similar to, the Stirling, Ericsson and the Carnot cycles.

It is an object of the present invention to provide a relatively simple effective heat engine operating with an efficient thermodynamic cycle.

A preferred object of the present invention is to provide a heat engine operable reversibly on an efficient thermodynamic cycle so as to be operable as a mechanical power source or as a heat pump, e.g., for refrigeration.

According to the present invention, there is provided a heat engine including: a closed case having internal walls defining a chamber and heat transfer surfaces located around the internal walls; a displacer rotatably mounted within the chamber and defining a working space between the displacer and the internal walls, the working space being moved around the chamber internal walls as the displacer rotates within the chamber, the working space in use containing a working fluid arranged to be subjected to changes in thermodynamic parameters; volume altering means operative to cyclically alter the volume of the working space in a predetermined manner as the displacer rotates within the chamber.

In operation, the heat transfer surfaces are preferably arranged to be maintained at differing temperatures around the path of movement of the working space. The heat engine case preferably includes regenerator means operative to transfer heat between or to and from different parts of the case and thereby between or to and from different parts of the heat transfer surfaces.

In a preferred construction, the chamber is generally cylindrical and the displacer is mounted for rotation about the central axial line extending through the chamber. The heat transfer surfaces may be defined at least in part by generally circumferentially extending surface portions which project generally radially inwardly from the chamber walls. To inhibit circumferential heat transfer through the surface portions, each surface portion may be at least partially isolated from each circumferentially adjacent surface portion. This may be achieved by providing radial spacing slots between adjacent surface portions.

The displacer may be provided with circumferentially extending displacer surface portions which project generally radially outwardly from the displacer circumference and which are generally complementary to the heat transfer surface portions so that the displacer is a close fit within the chamber in the case. The working space is preferably defined between the internal walls of the chamber and a portion of the outer surface of the displacer which is not provided with said radially outwardly extending displacer surface portions.

In one possible embodiment the volume altering means includes a piston reciprocally mounted within a cylinder in the displacer, one end of the cylinder being opened to the outer surface of the displacer at the location of the working space whereby reciprocation of the piston within the cylinder varies the volume of the working space. However, it will be appreciated that more than one piston/cylinder combination may be provided in the displacer and/or in the chamber internal walls in order to vary the volume of the working space.

In the preferred embodiment, the piston is coupled by a connecting arrangement to a main crank point offset from the axis of rotation of the displacer so that as the displacer rotates the piston reciprocates within the cylinder. In order to achieve a more desirable thermodynamic cycle, the engine may further include a superimposing crank mechanism operative to superimpose a movement on the main piston movement arising from the connection to the main crank point, the superimposing crank mechanism including a secondary crank point to which the piston is connected, the secondary crank point being cyclically movable relative to the main crank point during rotation of the displacer so as to produce a movement of the piston in which a generally constant volume of the working space is temporarily maintained at the two limits of movement of the piston while the displacer continues to rotate.

Example embodiments of the present invention will now be described with reference to the accompanying drawings in which:

FIGS. 1*a*, 1*b*, 1*c* show the pressure/volume diagrams for the Carnot, Stirling and Ericsson thermodynamic cycles discussed above, FIG. 2 is a schematic sectional side view of a heat engine according to a first preferred embodiment of the present invention, FIG. 3 is a sectional view of the heat engine shown in FIG. 2 seen along the line III—III in FIG. 2, FIG. 4 is a schematic sectional side view of a second embodiment of a heat engine according to the present invention, FIG. 5 is a view along the line V—V of FIG. 4.

Figure 3:
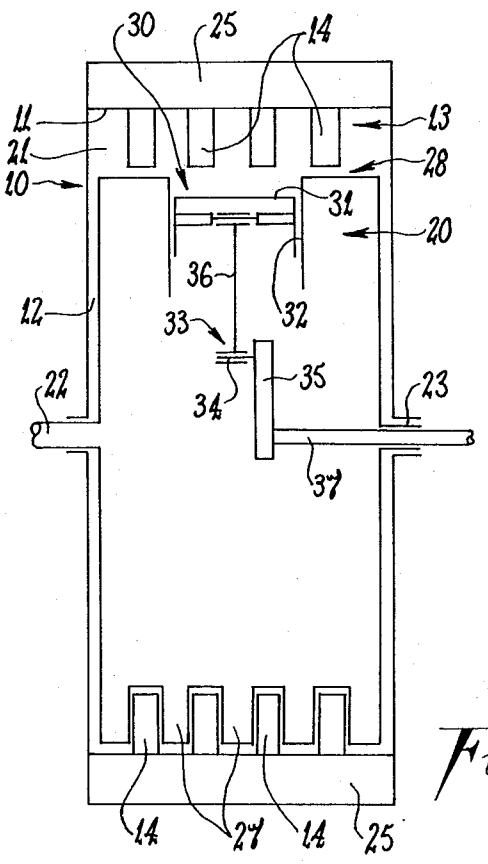
Figure 2:
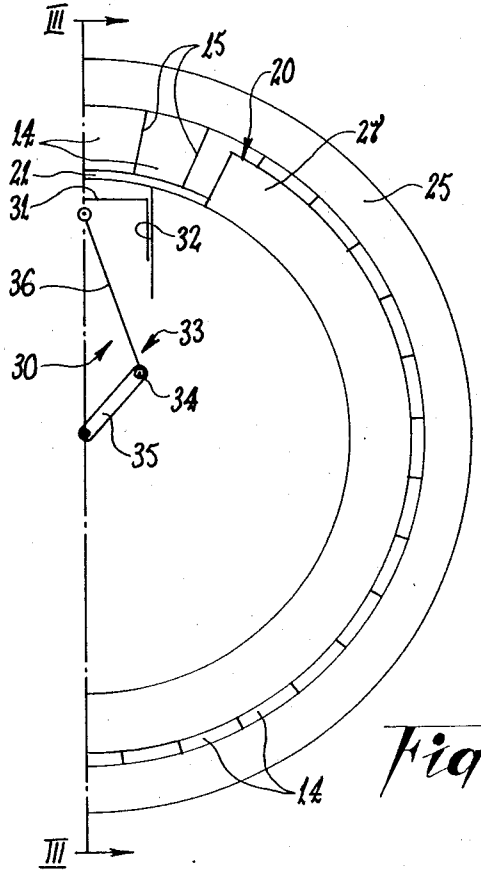

Referring now to the embodiment shown in FIGS. 2 and 3, the heat engine includes a closed case 10 having internal walls 11 defining a chamber 12. Heat transfer surfaces 13 are located around the internal walls 11. The closed outer case 10 may be made of any suitable material suitable for defining the sealed vessel and operating at the temperatures and pressures encountered. As illustrated, the case 10 can be generally drum-shaped so that the chamber 12 is generally cylindrical and the heat transfer surfaces 13 are generally circumferentially arranged around the cylindrical chamber 12.

The heat transfer surfaces 13 are defined at least in part by generally circumferentially extending surface portions 14 which project generally radially inwardly from the chamber walls 11. Each surface portion 14 is at least partially isolated from each circumferentially adjacent surface portion 14 so as to inhibit circumferential heat transfer through the surface portions. As seen in FIG. 2, this is achieved by generally radially directed divisions 15 between adjacent surface portions 14. The walls 11 of the case 10 may also constitute heat transfer surfaces.

The heat engine also includes a displacer 20 rotatably mounted within the chamber 12 and defining a working space 21 between the displacer 20 and the internal walls 11. The working space 21 is moved around the chamber internal walls 11 as the displacer 20 rotates within the chamber 12. The working space 21 in use contains a working fluid arranged to be subjected to changes in thermodynamic parameters. The heat transfer surfaces 13 are arranged to be maintained at differing temperatures around the path of movement of the working space 21 so as to facilitate heat flow to and from the working fluid in the working space 21. For example, the circumference of the chamber 12 having the heat transfer surfaces 13 may be exposed to different temperatures from low through increasing temperatures to high and through decreasing temperature zones around the full circumference.

The working fluid in the working space 21 may be a gas such as helium or hydrogen and preferably the working gas is under a pressure greater than atmospheric pressure. The working fluid is exposed to different pressures and temperatures throughout the thermodynamic cycle of the engine.

The displacer 20 is mounted for rotation about the central axial line extending through the chamber 12. As best seen in FIG. 3, the displacer 20 is rotatable on to bearing shafts 22,23 which protrude axially through the case walls 11, the cross-sectional areas of the two shafts 22,23 being equal where the shafts protrude through the case walls 11 so that forces on the shafts 22,23 produced by any difference in fluid pressures between the inside and outside of the case 10 are balanced. Of course, suitable bearings and seals would be provided for the shafts 22,23 although these are not shown in the drawings.

If desired, the displacer 20 may have a relatively large mass so as to function as a flywheel to minimise fluctuations in the angular velocity of the displacer 20.

The case 10 includes regenerator means 25 operative to transfer heat between or to and from different parts of the case 10 and thereby between or to and from different parts of the heat transfer surfaces 13. The engine can be provided with many conventional regenerators. For example, the regenerator means 25 may include a heat transfer fluid arranged to be circulated therein so as to effect the heat transfer. Alternatively, (or in addition) a heat engine arrangement may be provided and which comprises two heat engines generally in accordance with the present invention, the two heat engines being operable to run in different directions and being mounted adjacent to each other so that regenerative heat transfer between the two heat engines occurs. That is, the two engines would be mounted side by side with the respective parts of the two cases 10 which can benefit most from regeneration being closest to each other for heat transfer purposes.

Figure 7:
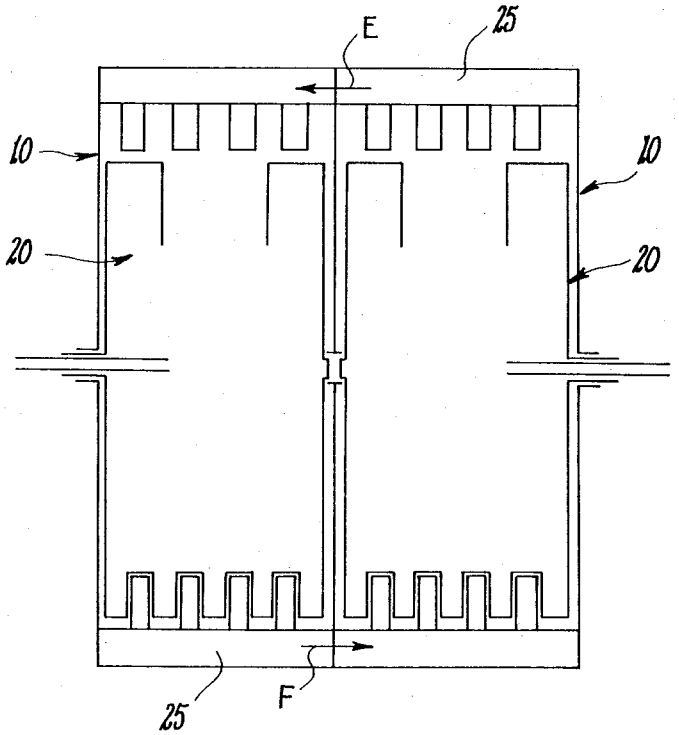
FIG. 7 shows two engines side-by-side arranged for regenerative heat transfer.

FIG. 7 illustrates two engines mounted side-by-side where the regenerators 25 are connected to each engine. The heat being given up during the cooling of the working fluid in the first engine is transferred to heating stage of the second engine.

Another possible regenerator would include means to transport the actual working fluid to and from the working space 21 and from one part of the engine to another. In this case, the regenerator may consist of channels or pipes and would preferably include a pumping means to encourage circulation of the working fluid.

Figure 6:
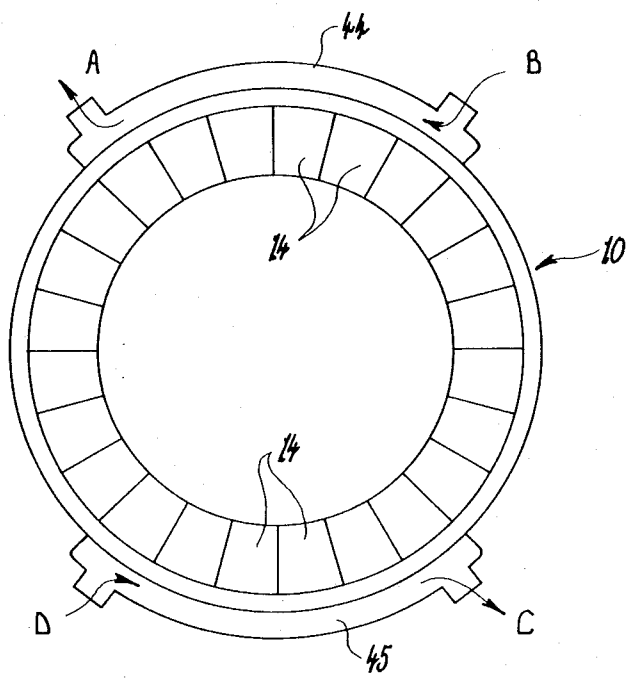
FIG. 6 shows a side view of the heat engine having means for maintaining the heat transfer surfaces at different temperatures.

FIG. 6 shows a side view of the heat engine provided with housing members 44 and 45 associated with the casing 10. A high temperature heat transfer medium is supplied to the inlet of housing 44 to heat the working space in that area of the case 10. A low temperature heat transfer medium is circulated through housing 45 to cool that portion of the case 10. In operation the fluid would circulate through the housing 44 and 45 passing from one to the other in the direction of the arrows. The circulation could be by natural convection or forced by a circulating pump. Circulated the fluid in this manner presents giving up heat in the cooling stage of the working fluid and transfers it to the other side of the case for reheating the working fluid.

The displacer 20 shown in FIGS. 2 and 3 is provided with circumferentially extending displacer surface portions 27 which project generally radially outwardly from the circumference of the displacer 20 and which are generally complementary to the heat transfer surface portions 13 so that the displacer 20 is a close fit within the chamber 12 in the case 10. As best seen in FIG. 3, the surface portions 27 are in the general form of annular rings which mesh with the surface portions 14 of the case 10. The displacer 20 in use rotates in the case 10 and power is transmitted to or from the engine by means of the displacer. For example, the shaft 22 may comprise a power take-off or power input shaft.

The working space 21 is defined between the internal walls 11 of the chamber 12 and a portion 28 of the outer surfaces of the displacer 20 which is not provided with the radially outwardly extending displacer surface portions 27. That is, the portion 28 is constituted by a segment or section of the circumference of the displacer 20 which has the annular rings 28 removed or reduced in volume so that the working fluid in the remaining working space 21 is carried around the circumference of the chamber 12 and through the different temperature zones as the displacer 20 rotates.

The heat engine also includes volume altering means 30 operative to cyclically alter the volume of the working space 21 in a predetermined manner as the displacer 20 rotates within the chamber 12. The volume altering means 30 illustrated in the drawings includes a piston 31 reciprocally mounted within a cylinder 32 in the displacer 20, one end of the cylinder 32 being open to the outer surface of the displacer at the location 28 of the working space 21 whereby reciprocation of the piston 31 within the cylinder 32 varies the volume of the working space 21. With this arrangement, the piston and cylinder are carried around with the displacer as the displacer 20 rotates within the chamber 12.

The position of the piston 31 within the cylinder 32 is determined by a mechanical assembly which is operative to cause the piston to reciprocate as the displacer 20 rotates. The mechanism assembly shown in FIGS. 2 and 3 comprises a connecting arrangement 33 by which the piston 31 is coupled to a main crank point 34 offset from the axis of rotation of the displacer 20 so that as the displacer 20 rotates the piston 31 reciprocates within the cylinder 32. The connecting arrangement 33 in particular includes a crank arm 35 (referred to henceforth as the main crank 35) and a connecting rod 36 between the main crank 35 and the piston 31. The main crank 35 is connected to a crank shaft 37 which extends axially out of the case 10. The eccentrically located crank pin between the main crank 35 and the connecting rod 36 defines the main crank point 34.

It will be seen that the main crank point may be held in a fixed position relative to the case 10 and as the displacer 20 rotates the piston 31 will reciprocate within the cylinder 32 completing one cycle for each complete revolution of the displacer 20. Although it is expected that the main crank point 34 will be fixed in position during operation of the engine, preferably the main crank point 34 can be selectively moved so as to enable selective variation and adjustment of the nature of the engine operating cycle. This variation of the operating cycle can be achieved by angular adjustments of the crank shaft 37. Of course, it may be desirable to vary the position of the main crank point 34 during operation of the engine to achieve selective variation of the efficiency, power output, etc., of the engine.

Figure 5:
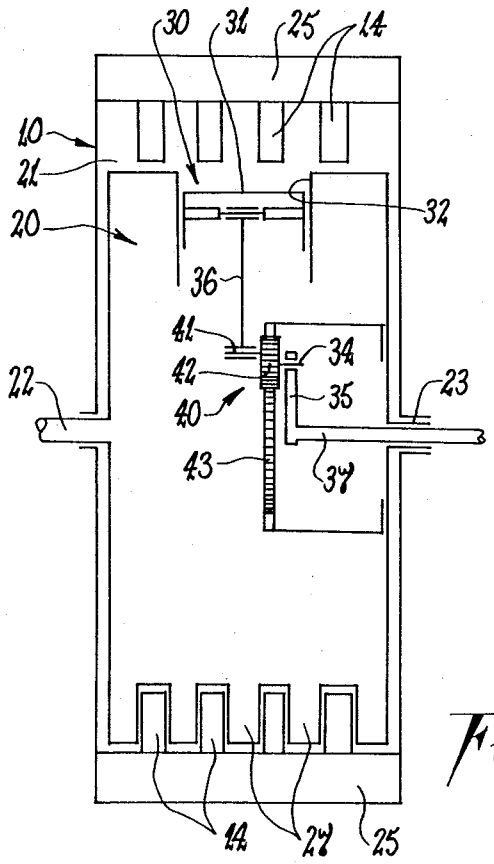
Figure 4:
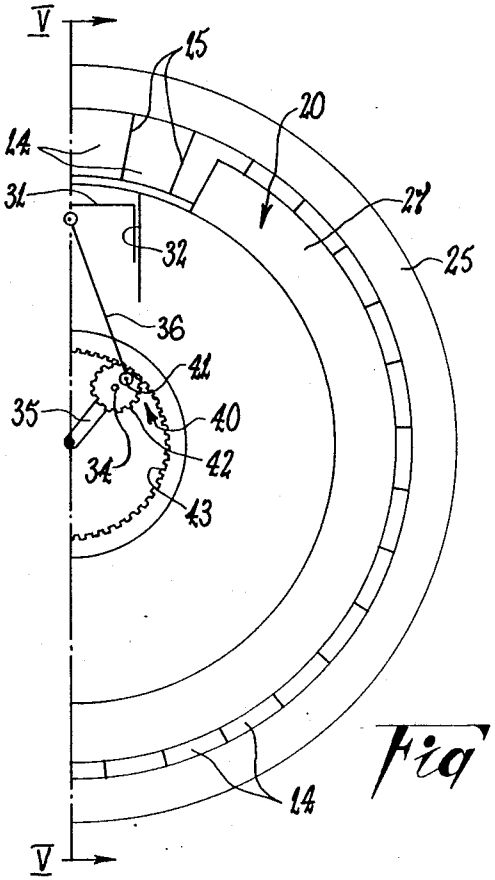

Referring now to FIGS. 4 and 5, which show a second possible embodiment of a heat engine according to the present invention, the same reference numerals as used in FIGS. 2 and 3 have been used for corresponding components. The engine in FIGS. 4 and 5 includes a superimposing crank mechanism 40 operative to superimpose a movement on the main movement of the piston 31 arising from the connection to the main crank point 34. The superimposing crank mechanism 40 includes a secondary crank point 41 to which the piston 31 is connected, the secondary crank point 41 being cyclically movable relative to the main crank point 34 during rotation of the displacer 20. This superimposing movement can produce a movement of the piston 31 in which a generally constant volume of the working space 21 is temporarily maintained at the two limits of movement of the piston 31 while the displacer 20 continues to rotate. As can be readily understood from FIGS. 4 and 5, the coupling of the piston 31 to the main crank point 34 produces a generally sinusoidal main reciprocation of the piston 31 within the cylinder 32 and the coupling of the piston 31 to the secondary crank point 41 results in a superimposition of a relatively low amplitude generally sinusoidal secondary reciprocation. Preferably, the frequency of the secondary reciprocation is equal to three times the frequency of the main reciprocation in order to produce an engine operating cycle closely approximating an ideal thermodynamic cycle, in particular, the Stirling cycle.

The particular superimposing crank mechanism 40 shown in FIGS. 4 and 5 includes a gear wheel 42 which is mounted for rotation about an axis passing through the main crank point 34. The piston 31 is coupled to the secondary crank point 41 which is constituted by a point radially displaced on the gear wheel 42. The gear wheel 42 meshes with a circular gear wheel or rack 43 mounted on the displacer 20 so that while the displacer 20 completes one revolution the gear wheel 42 completes three revolutions.

As with the main crank 35 in FIGS. 2 and 3, it is expected that the circular gear wheel or rack 43 would be fixed in position on the displacer 20 during operation of the engine. However, preferably, the circular gear rack 43 can be selectively rotated relative to the displacer 20 so as to enable selective variation and adjustment of the nature of the operating cycle of the engine. In particular, rotation of the gear 43 will alter the phase of the superimposing movement provided by rotation of the gear wheel 42 relative to the phase of the main oscillation of the piston 31 provided by the main crank 35. Thus, the preferred embodiment of the engine in FIGS. 4 and 5 enables considerable variation of the nature of the thermodynamic cycle upon which the heat engine is operating.

It will be appreciated that various additions and modifications may be made to the construction and arrangement as shown and described with references to FIGS. 2 to 5. For example, the inside volume of the displacer 20 may constitute a buffer zone for the volume altering means 30, i.e., behind the piston 31, so that the force on the volume altering means 30 more closely relates to the difference in pressure between the average cycle pressure of the working fluid contained in the working space 21 and the instantaneous working fluid pressure subsisting in the working space 21. Preferably, the inside volume of the displacer is well sealed from the working space 21.

Figure 8:
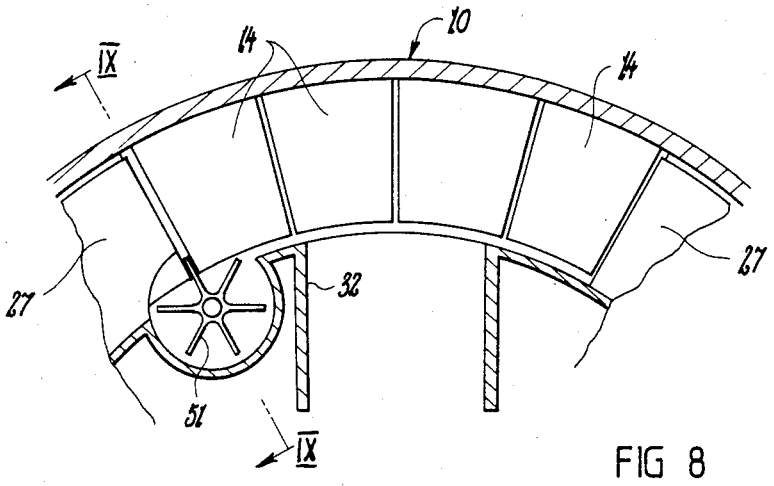
FIGS. 8 and 9 show partial side sectional and partial cross sectional views respectively of an engine having fan means for promoting circulation of working fluid.
Figure 9:
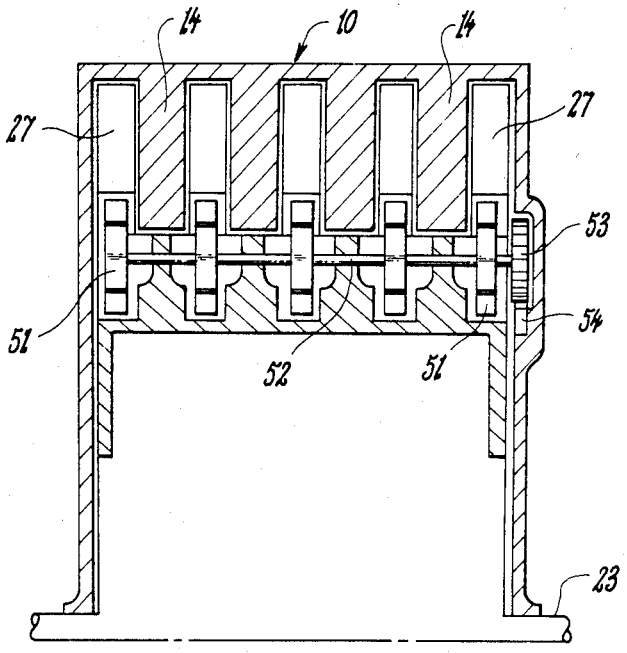

Referring to FIGS. 8 and 9 one type of fan or blower includes a plurality of fan members 51 secured to a shaft 52 rotatably mounted to the displacer. A ring gear 54 is provided in the side of the case around the axis of rotation of the displacer. A second gear 53 on the shaft 52 meshes with the ring gear. As can be readily seen, when the displacer rotates in relation to the case 10, the fans will be driven circulating the working fluid.

A further optional modification in order to improve heat transfer involves the provision of a fan or blower means (not shown) operative to promote working fluid circulation within the working space 21 to thereby improve heat transfer to and from the working fluid. The fan or blower means may be mounted in the displacer 20. Preferably, the fan or blower means is driven by rotation of the displacer 20 within the chamber 12 for example, by means of a pair of gears one associated with the fan or blower and the other provided on the case 10. The fan or blower means would increase the circulation velocity of the working fluid in the space 21.

The gear wheel 42 in FIGS. 4 and 5 itself provides the secondary crank point 41 but it will be appreciated that a separate minor crank may be provided to which the connecting rod 36 is coupled, the minor crank being driven by the gear 42. Also the minor crank gear 42 can be mounted on either side of the main crank 35. If desired pulleys or other devices for transmitting rotational power may be used instead of the gear arrangement in order to achieve the superimposing movement of the connecting rod 36.

It will be appreciated that more than one heat engine according to the present invention can be connected together. The engines do not necessarily need to be operating on a common thermodynamic cycle. One or more of the engines can be run with reversed cycles. This particular configuration can be used for refrigeration or heat pumping purposes.

An example embodiment of the present invention can be proportioned and adjusted so that when it runs, it can operate with thermodynamic engine cycles which closely approximate true reversible thermodynamic cycles. Alternatively, a wide variety of thermodynamic cycles is possible.

Figure 1A:
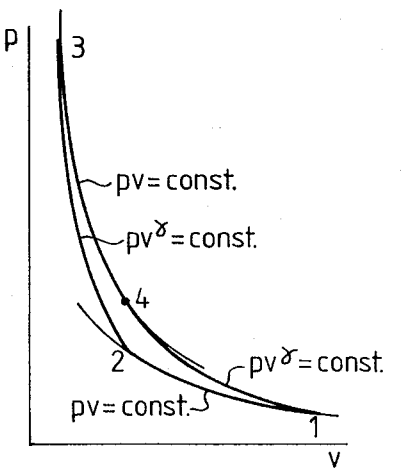
Figure 1B:
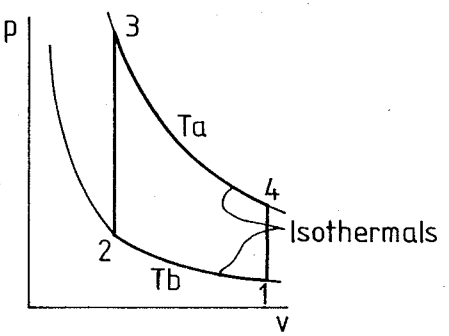

For example, to run the heat engine according to the present invention with a cycle closely resembling a Stirling cycle, the outer case is divided into four separate heat transfer zones (refer to FIG. 1*b*). The four zones may be equal in size. The first zone is a cold zone (1 to 2 in FIG. 1*b*), the next is a heating zone (2-3), the next a hot zone (3-4) and the last a cooling zone, (4-1). The volume altering means 30 for the working space 21 is set to minimise the volume of the space 21 as the working space 21 passes through zone 2 to 3 and maximise the volume as the working volume passes through zone 4 to 1. The volume decreases between zones 1 and 2 and increases between zones 3 and 4.

Figure 1C:
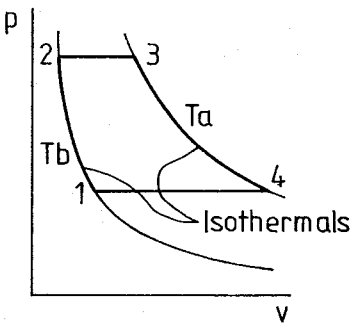

To run the engine with a cycle closely resembling an Ericsson cycle, the outer case 20 is divided into the same four heat transfer zones (refer to FIG. 1*c*). The volume altering means 30 for the working space 21 is set to maximise the pressure as the working space 21 passes through zone 2 to 3 and minimise the pressure as the working space 21 passes through zone 4 to 1.

If the engine follows the thermodynamic conditions in the order 1, 2, 3, 4 given in FIGS. 1*b* or 1*c*, then power will be delivered from the engine. If it follows the conditions in the order 1, 4, 3, 2 then, power will be consumed by the engine.

The minor crank constituted by gear 42 providing secondary crank point 41 and described in the second preferred form of the engine, permits close approximations to true constant pressure or constant volume conditions, which may be required for certain zones of the ideal thermodynamic cycles. Other thermodynamic conditions are also possible.

For the Stirling cycle, the minor crank may be set at bottom dead centre when the main crank is at top dead centre with the working space halfway through zone 2 to 3 in FIG. 1*b*. Then, when the main crank is at bottom dead centre, the minor crank will also be at bottom dead centre with the working space halfway through zone 4 to 1.

For the Ericsson cycle, the minor and main cranks may be set at top dead centre with the working space positioned in zone 2. Both will be at bottom dead centre when the working space is in zone 4.

The ratio of the lengths of the minor and main cranks determines the accuracy of these approximately constant volume zones. Typically, this ratio is about 0.134.

As mentioned above, the angular positions of the main and minor cranks may be altered, in relation to the different outer case temperature zones and the displacer respectively. It is then possible to also allow for time delays in heat transfer processes, variation in power outputs or consumptions or different thermodynamic cycles.

What I claim is:

1. A heat engine including: a closed case having internal walls defining a chamber and heat transfer surfaces located around the internal walls; a displacer rotatably mounted within the chamber and defining a relatively large working space between the displacer and the internal walls, the working space being moved around the chamber internal walls as the displacer rotates within the chamber, the working space in use containing a volume of working fluid arranged to cooperate with the heat transfer surfaces and thus to be subjected to changes in thermodynamic parameters; volume altering means operative to cyclically increase and decrease the volume of a portion of said working space in a predetermined manner as the displacer rotates within the chamber, the volume of said working space less the volume of said portion thereof being of significant magnitude relative to the volume of said portion at all times as the displacer rotates within said chamber.

2. A heat engine as claimed in claim 1, wherein the heat transfer surfaces are arranged to be maintained at differing temperatures around the path of movement of the working space.

3. A heat engine as claimed in claim 2, wherein the case includes regenerator means operative to transfer heat between or to and from different parts of the case and thereby between or to and from different parts of the heat transfer surfaces.

4. A heat engine as claimed in claim 2, wherein the chamber is generally cylindrical and the displacer is mounted for rotation about the central axial line extending through the chamber.

5. A heat engine as claimed in claim 4, wherein the heat transfer surfaces are defined at least in part by generally circumferentially extending surface portions which project generally radially inwardly from the chamber walls.

6. A heat engine as claimed in claim 5, wherein each said surface portion is at least partially isolated from each circumferentially adjacent surface portion so as to inhibit circumferential heat transfer through the surface portions.

7. A heat engine as claimed in claim 5, wherein the displacer is provided with the circumferentially extending displacer surface portions which project generally radially outwardly from the displacer circumference and which are generally complementary to the heat transfer surface portions so that the displacer is a close fit within the chamber in the case.

8. A heat engine as claimed in claim 7, wherein said working space is defined between the internal walls of the chamber and a portion of the outer surface of the displacer which is not provided with said radially outwardly extending displacer surface portions.

9. A heat engine as claimed in claim 4, wherein the displacer is rotatable on two bearing shafts which protrude axially through opposite sides of the case walls, the cross-sectional areas of the two shafts being equal where the shafts protrude through the case walls so that the forces on the shafts produced by the difference in fluid pressures between the inside and outside of the case are balanced.

10. A heat engine as claimed in claim 4, wherein the displacer functions as a flywheel to minimise fluctuations in the angular velocity of the displacer.

11. A heat engine as claimed in claim 1, wherein the displacer is hollow so as to define an inside volume which constitutes a buffer zone for the volume altering means so that the force on the volume altering means more closely relates to the difference in pressure between the average cycle pressure of the working fluid contained in the working space and the instantaneous working fluid pressure subsisting in the working space.

12. A heat engine including: a closed case having internal walls defining a chamber and heat transfer surfaces located around the internal walls; a displacer rotatably mounted within the chamber and defining a relatively large working space between the displacer and the internal walls, the working space being moved around the chamber internal walls as the displacer rotates within the chamber, the working space in use containing a volume of working fluid arranged to cooperate with the heat transfer surfaces and thus to be subjected to changes in thermodynamic parameters; volume altering means operative to cyclically increase and decrease the volume of a portion of said working space in a predetermined manner as the displacer rotates within the chamber, said displacer including a cylinder therein, one end of the cylinder being opened to the outer surface of the displacer at the location of the working space so that the cylinder defines said portion of said working space, said volume altering means including a piston reciprocally mounted within the cylinder whereby reciprocation of the piston within the cylinder varies the volume of said portion of the working space.

13. A heat engine as claimed in claim 12, wherein the piston is coupled by a connecting arrangement to a main crank point offset from the axis of rotation of the displacer so that as the displacer rotates the piston reciprocates within the cylinder.

14. A heat engine as claimed in claim 13, wherein the main crank point is fixed in position during operation of the engine but can be selectively moved so as to enable selective variation and adjustment of the nature of the operating cycle.

15. A heat engine as claimed in claim 13, and further including a superimposing crank mechanism operative to superimpose a movement on the main piston movement arising from the connection to the main crank point, the superimposing crank mechanism including a secondary crank point to which the piston is connected, the secondary crank point being cyclically movable relative to the main crank point during rotation of the displacer so as to produce a movement of the piston in which a generally constant volume of the working space is temporarily maintained at the two limits of movement of the piston while the displacer continues to rotate.

16. A heat engine as claimed in claim 15, wherein the coupling of the piston to the main crank point produces a generally sinusoidal main reciprocation of the piston within the cylinder and the coupling of the piston to the secondary crank point results in a superimposition of a relatively low amplitude generally sinusoidal secondary reciprocation of a frequency equal to three times the frequency of the main reciprocation in order to produce an engine operating cycle closely approximating an ideal thermodynamic cycle.

17. A heat engine as claimed in claim 16, wherein the superimposing crank mechaniem includes a gear wheel mounted for rotation about an axis passing through the main crank point, the piston being coupled to the secondary crank points which is constituted by a point radially displaced on the gear wheel, the gear wheel meshing with a circular gear rack mounted on the displacer so that while the displacer completes one revolution the gear wheel completes three revolutions.

18. A heat engine as claimed in claim 17, wherein the circular gear rack is fixed in position on the displacer during operation of the engine but can be selectively rotated relative to the displacer so as to enable selective variation and adjustment of the nature of the operating cycle.

19. A heat engine including: a closed case having internal walls defining a chamber and heat transfer surfaces located around the internal walls; a displacer rotatably mounted within the chamber and defining a relatively large working space between the displacer and the internal walls, the working space being moved around the chamber internal walls as the displacer rotates within the chamber, the working space in use containing a volume of working fluid arranged to cooperate with the heat transfer surfaces and thus to be subjected to changes in thermodynamic parameters; volume altering means operative to cyclically increase and decrease the volume of a portion of said working space in a predetermined manner as the displacer rotates within the chamber; a fan or blower means operative to promote working fluid circulation within the working space and thereby improve heat transfer to and from the working fluid through said heat transfer surfaces.

20. A heat engine as claimed in claim 19, wherein the fan or blower means is driven by rotation of the displacer within the chamber.

21. A heat engine arrangement comprising two heat engines, each of the two heat engines including: a closed case having internal walls defining a chamber and heat transfer surfaces located around the internal walls; a displacer rotatably mounted within the chamber and defining a relatively large working space between the displacer and internal walls, the working space being moved around the chamber internal walls as the displace rotates within the chamber, the working space in use containing a volume of working fluid arranged to cooperate with the heat transfer surfaces and thus to be subjected to changes in thermodynamic parameters; volume altering means operative to cyclically increase and decrease the volume of a portion of said working space in a predetermined manner as the displacer rotates within the chamber; the two heat engines being operable to run in opposite directions and being mounted adjacent to each other so that regenerative heat transfer between the two heat engines occurs.

* * * * *